United States Patent [19]

Waschulzik et al.

[11] 3,936,032

[45] Feb. 3, 1976

[54] APPARATUS WITH A WORKING PLATFORM AND ADJUSTABLE LEGS THEREFOR

[75] Inventors: Walter Waschulzik, Dulmen; Maximilian Dyczek, Dortmund-Brechten, both of Germany

[73] Assignee: Gewerkschaft Eisenhutte Westfalia, Westphalia, Germany

[22] Filed: Apr. 15, 1974

[21] Appl. No.: 461,217

[30] Foreign Application Priority Data

Apr. 19, 1973 Germany ..... 2319931

[52] U.S. Cl. ..... 254/108

[51] Int. Cl.[2] ..... B66F 7/16

[58] Field of Search ..... 254/105–111; 61/46.5

[56] References Cited

UNITED STATES PATENTS

| | | | |
|---|---|---|---|
| 2,932,486 | 4/1960 | Suderow | 254/107 |
| 3,411,750 | 11/1968 | Smulders | 254/110 |
| 3,517,910 | 6/1970 | Sutton et al. | 254/106 |
| 3,565,400 | 2/1971 | Yamura | 254/106 |
| 3,604,683 | 9/1971 | Sutton | 254/106 |
| 3,765,649 | 10/1973 | Raaymakers | 254/106 |

*Primary Examiner*—Al Lawrence Smith
*Assistant Examiner*—Robert C. Watson
*Attorney, Agent, or Firm*—Thompson, Birch, Gauthier & Samuels

[57] ABSTRACT

Apparatus with a platform or the like and a plurality of adjustable support legs extending through the platform. Each leg is provided with a device at the upperside of the platform which can effect relative displacement between the leg and the platform. Each of these devices takes the form of upstanding support members disposed around the leg and each having a foot plate which engages in a shoe on the platform. Each foot plate and its shoe have inter-engaging curved surfaces constituting spherical joints which permit the support members and hence the device as a whole to perform angular deviations from a vertical position.

Hydraulic rams are suspended from the upper ends of each of a pair of support members on diametrically opposite sides of the leg. These rams are interconnected by a carriage which supports a locking mechanism which has a plunger capable of engaging in one of a series of vertically-spaced recesses in a bar of each of the diametrically opposite sides of the leg. Further locking mechanisms also have plungers engageable in these recesses and each of these mechanisms has a carrier for the plunger mounted for displacement on brackets affixed to the associated support member. A motor coupled through gearing serves to move the carriers in relation to these brackets to control alignment between the plungers and the recesses.

14 Claims, 3 Drawing Figures

APPARATUS WITH A WORKING PLATFORM AND ADJUSTABLE LEGS THEREFOR

BACKGROUND OF THE INVENTION

The present invention relates to apparatus with a working platform provided with adjustable legs. The term "platform" used throughout this specification and claims is intended to include pontoons and other like superstructures supported by legs and capable of being raised or lowered in relation to these legs for a variety of purposes.

Apparatus of the above mentioned kind is described in German patent specification No. 1107603. In this known apparatus the platform has openings therein and the legs, which can be raised or lowered in relation to the platform, extend through these openings. In order to raise or lower each leg and to raise or lower the platform, relative to all the legs, each leg is provided with a hoisting device which is capable of effecting relative movement between the leg and the platform. It is necessary with this apparatus to ensure that the legs are aligned correctly in relation to the hoisting devices. However, in practice, due to the clearance of the openings in the platform, the legs can deviate from vertical positions especially where there is unevenness in the ground surface supporting the legs. Even quite small angular deviations can cause problems and it is possible in adverse conditions for the legs to become jammed in the openings if serious misalignment occurs.

With regard to the foregoing a general object of this invention is to provide an improved apparatus.

SUMMARY OF THE INVENTION

According to the invention there is provided an apparatus comprising a platform, a plurality of legs capable of supporting the platform, each leg being operably associated with a device for effecting relative movement between the leg and the platform to raise or lower the platform or raise or lower the individual leg, said device being mounted on the platform so as to be movable to a limited extent as a whole in relation to the platform and the associated leg. The provision for movement of the devices associated with the legs can cope with any angular movement of a leg from a vertical position and can provide a uniform distribution of loading.

Preferably each device has a plurality of support members which are generally upstanding relative to the platform and there is provided means connecting the support members to the platform and permitting the support members to move angularly through an angle of about 3°–5° in relation to said platform to provide the mobility of the device as a whole.

The connecting means can take the form of a foot plate provided at a lower portion of each support member and engaging within a shoe affixed to the platform.

Preferably the foot plates and shoes have interengaging curved surfaces constituting spherical joints. These curved surfaces may diverge from the platform in a direction towards the associated leg and the centre of curvature of the surfaces preferably lies on the longitudinal axis of the leg and in a plane containing the undersurfaces of the platform.

Hydraulic rams may effect the relative movement between each leg and the platform and two such rams can be suspended from a traverse extending between the upper ends of two support members.

A locking mechanism capable of engaging with a leg to lock thereto can be supported by a carriage connected between the rams. Each leg may have one or more bars provided with vertically spaced recesses capable of receiving a displaceable element or plunger of the locking mechanism associated therewith. In this way each leg can be selectively locked to a movable part of the device associated therewith.

Preferably further separate locking mechanisms capable of selectively locking the legs to the platform are provided. The further locking mechanisms may each have a displaceable element or plunger supported by a carrier and also engageable in the recesses of the bar of the leg associated therewith. These carriers are preferably displaceably supported by brackets or the like affixed to the support members of the device. Means can then be provided to adjust the carriers in relation to the support members to ensure correct alignment between their plungers and the recesses of the bars. This adjustment means, which is independent of the rams, makes it possible to compensate for slight misalignment between the plungers and the recesses and can ensure a uniform load distribution to the legs. This adjustment means can be in the form of a motor, preferably a hydraulic motor, coupled via gears to threaded bushes which engage with spindles connected to the carriers of the further locking mechanisms of each leg.

The invention may be understood more readily and various other features of the invention may become apparent from consideration of the following description.

BRIEF DESCRIPTION OF DRAWINGS

An embodiment of the invention will now be described by way of example only, with reference to the accompanying drawings, wherein.

DESCRIPTION OF PREFERRED EMBODIMENTS

Figure 1:
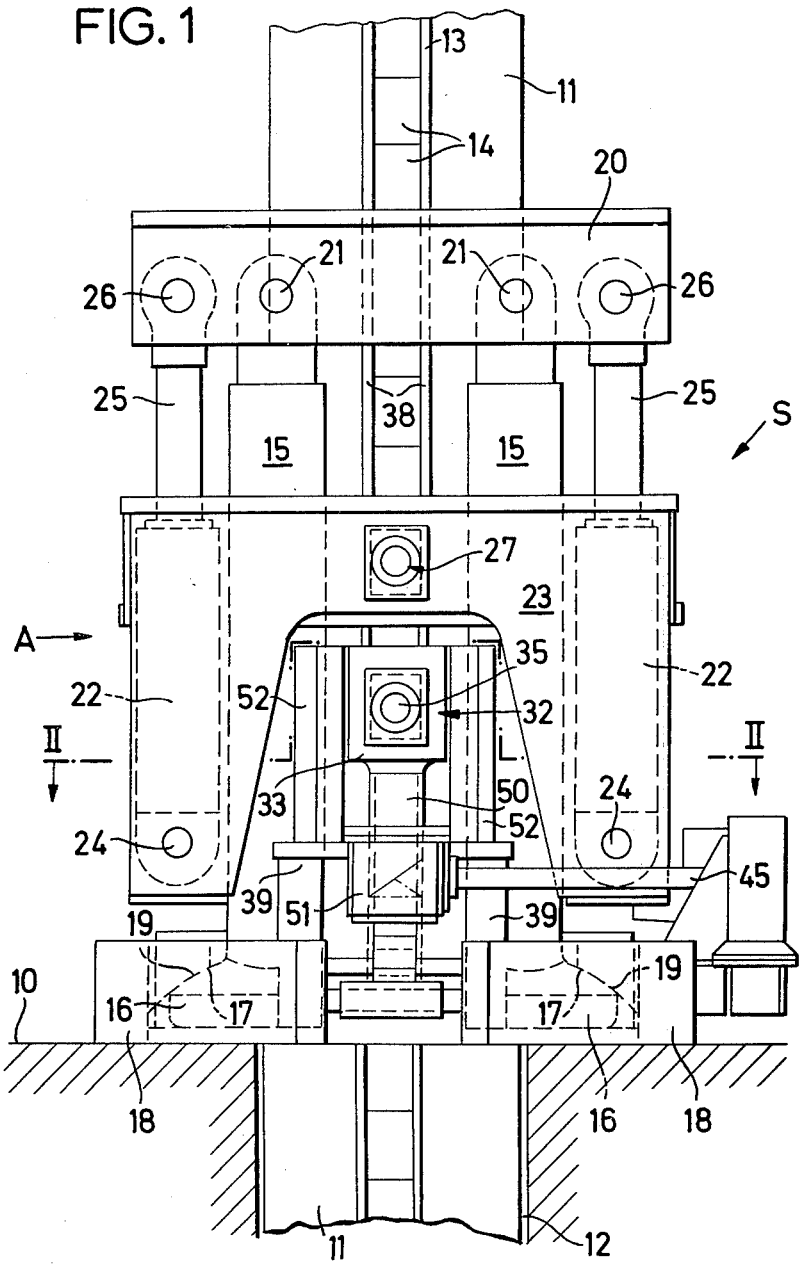
FIG. 1 is a schematic part-sectional front view of part of an apparatus made in accordance with the invention.

The apparatus to which the invention relates has a working platform 10 which is provided with a number of legs 11. Only part of the platform 10 and part of one of these legs 11 is represented in the drawings. The legs 11 which can be tubular extend through openings 12 in the platform 10 and the platform 10 can be raised or lowered in relation to the legs 11 or vice versa. The platform 10 may be the pontoon of hoisting apparatus disposed in water for example and, depending on the particular environment, the legs 11 may engage on a ground surface or on a bed under the water to support the platform.

Figure 2:
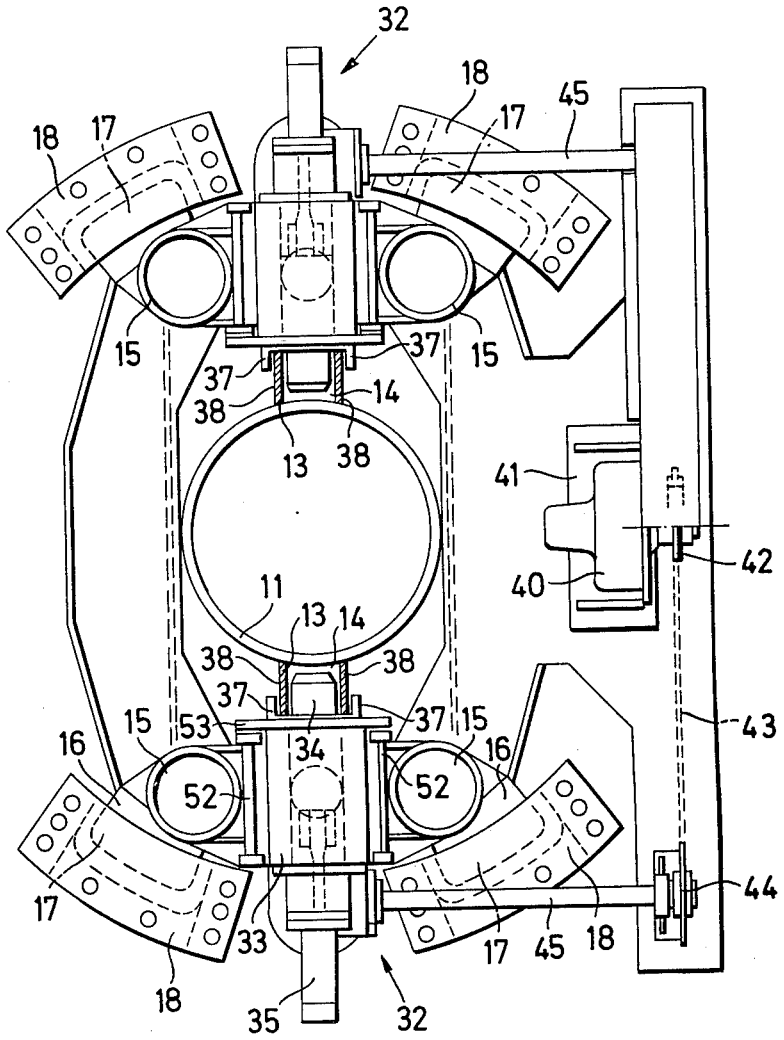
FIG. 2 is a sectional plane view taken along the line II — II of FIG. 1.
Figure 3:
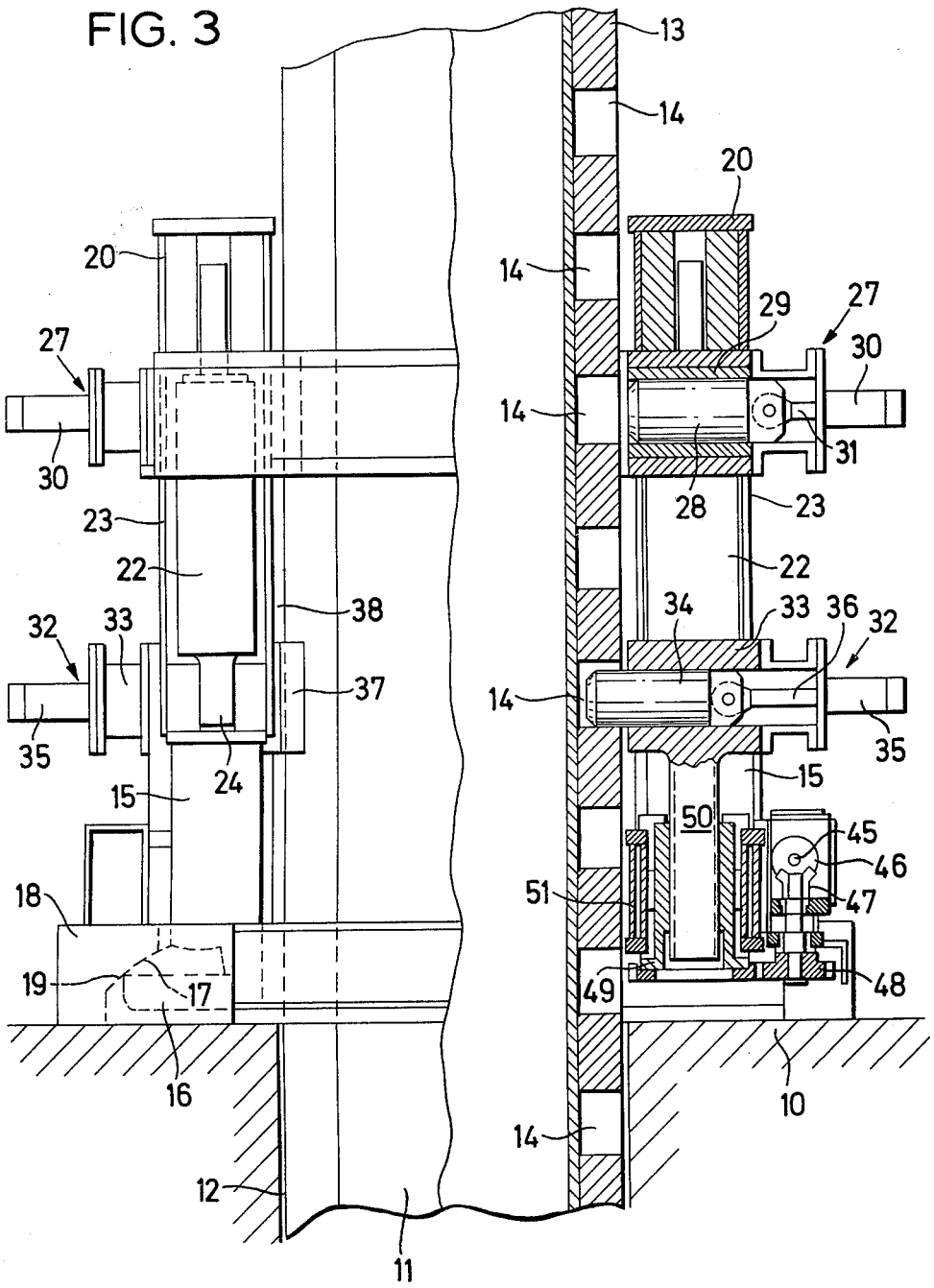
FIG. 3 is a part sectional end view taken in the direction of arrow A of FIG. 1.

Each leg 11 is operably associated with a device generally denoted by reference S. Each device S is adapted to effect selective movement between the associated leg 11 and the platform 10 to riase or lower either with respect to the other. Each leg 11 has upstanding bars 13 located diametrically opposite to one another. These bars 13 each have a series of vertically spaced recesses 14 which cooperate with the device S as described hereinafter. Each device S has four upstanding support members 15, conveniently in the form of tubes, which are disposed as shown in FIG. 2, on diametrically opposite sides of the associated leg 11 so that a pair of members 15 are disposed side-by-side in proximity to each of the bars 13. The members 15 are connected to the platform 10 in such manner as to allow a limited amount of angular movement between each member 15, and hence between the device S as a whole, and the platform 10. More particularly, each member 15 has a locating foot plate 16 at its base portion. Each foot plate 16 has a curved surface 17 of convex form on its upper surface and extends generally tangentially of the associated member 15. Each foot plate 16 is received within a box-like shoe 18 rigidly affixed as by bolts or welding to the platform 10. Each shoe 18 has a curved inner surface 19 of concave form which mates with the curved surface 17 of the associated foot plate 16. As shown in FIG. 1, the surface 17, 19 are also generally inclined in relation to the platform 10 so as to diverge therefrom in a direction towards the associated leg 11. The centre of curvature of the surfaces 17, 19 is located on the axis of the associated leg 11, and preferably lie on a horizontal plane extending through the plane undersurface of the platform 10. It is feasible to have a concave surface on each foot plate 16 and a convex surface within each shoe 18. In any event the curved surfaces 17, 19 form spherical joints permitting the members 15 to perform limited angular displacements in all direction in relation to the platform 10 from a nominal position normal to the platform 10.

Preferably the angular displacement in any direction is about 3° to 5° from the normal position.

Each pair of support members 15, located on the outerside of each bar 13, are interconnected at their upper ends by means of a traverse 20. Each support member 15 has a head portion which is pivotably connected to the associated traverse 20 with the aid of a pin 21. Each traverse 20 is connected near its ends to the piston rods 25 of two upstanding hydraulic double-acting rams 22. The piston rods 25 of the rams 22 are pivotably connected to the traverse 20 with the aid of a pin 26. The cylinders of these two rams 22 are also pivotably connected with the aid of pins 24 to a carriage 23. Each carriage 23 is generally U-shaped as shown in FIG. 1 and has a central bridge portion which carries a locking mechanism 27. This locking mechanism 27 is selectively engageable with the recesses 14 in the associated bar 13. Each locking mechanism 27 takes the form of a displaceable plunger 28 slidably mounted in a guide 29 affixed to the carriage 23. Means, in the form of a small hydraulic double-acting piston and cylinder unit 30, serves to displace the plunger 28 longitudinally to bring the latter into or out of one of the recesses 14 of the bar 13 aligned therewith. An adjustable linkage 31 is coupled between the unit 30 and the plunger 28. By means of the locking mechanisms 27 the carriages 23 can be selectively connected to the legs 11 associated therewith.

Beneath each mechanism 27 there is further lower locking mechanism 32 which is also in the form of a plunger 34 slidably mounted in a sleeve bore of a carrier 33 and coupled through an adjustable linkage 36 to a hydraulic double-acting piston and cylinder unit 35. The carrier 33 is mounted on brackets 39 attached to the associated members 15 so as to be generally movable therewith with provision, as described hereinafter, for movement in relation to these brackets 39. The carrier 33 has support arms 37 which slidably engage on side flanges 38 of the bar 13 associated therewith to guide the mechanism 32 thereon. Similar support arms can be provided for the guide 29 of the upper locking mechanism 27.

Adjustment means is provided to compensate for the movement of the mechanisms 32 with the support members 15 and to thereby ensure that each of the plungers 34 thereof can be correctly aligned with a respective one of the recesses 14 of the bars 13. This adjustment means takes the form of a motor 40, preferably a hydraulic motor, carried on a bracket 41. The motor 40 has a drive shaft which carries sprocket wheels 42 which drivably engage endless chains 43 which are entrained around further sprocket wheels 44.

Each sprocket wheel 44 is carried by a shaft 45 which serves to drive a worm wheel 46 which is drivably coupled through gearwheels 47, 48 to a threaded bush 49 which is in screw-threaded engagement with an upstanding spindle 50. Each spindle 50 is affixed to the carrier 33 of the associated locking mechanism 32 and may be integral therewith. Each spindle 50 and its associated bush 49 are supported by a housing 51 connected to the brackets 39. The brackets 39 are provided with upstanding guide tracks 52 and the carrier 33 of the associated locking mechanism 32 has further guide arms 53 which slidably locate on the tracks 52. By means of the motor 40 and the associated drive components it is thus possible to raise or lower the spindles 50 and hence the carriers 33 of the locking mechanisms 32 through a small controlled distance sufficient to cope with any angular displacement of the members 15.

The operation of the apparatus will now be described. In general, actuation of the rams 22 in conjunction with the locking mechanisms 27, 32 achieves relative displacement between the platform 10 and the legs 11. Dealing first with movement of the individual legs 11, assume that it is desired to raise one of the legs 11 relative to the platform 10. The locking mechanisms 27 associated with the leg 11 in question are then actuated to bring the plungers 28 thereof into respective openings 14 of the bars 13 of the leg 11. The plungers 34 of the locking mechanisms 32 are in this case disengaged from the bars 13. The rams 22 are now subjected to pressure fluid to retract and since the piston rods 25 are secured to the members 15 via the traverses 20 the cylinders, and hence the carriages 23, will rise. Since the locking mechansisms 27 secure the carriages 23 to the leg 11 the latter will also be raised. Depending on the extent of the desired movement of the leg 11 it may be necessary to operate the rams 22 a number of times. Thus when the rams 22 have been fully retracted the locking mechanisms 27 would be actuated to disengage the plungers 28 from the recesses 14 in the bars 13. The locking mechanisms 32 are now actuated to bring their plungers 34 into engagement with recesses 14 of the bars 13 to support the leg 11. Any adjustment necessary to achieve this is effected by the motor 40 acting on the spindles 50. Thereafter the rams 22 are subjected to pressure fluid to extend and then the locking mechanisms 27 are re-actuated to bring their plungers 28 into recesses 14 in the bars 13. The plungers 34 of the locking mechanisms 32 are now disengaged and the rams 22 retracted to again raise the leg 11 as before. This sequence can be repeated several times. To lower the leg 11 the rams 22 are conversely extended when the plungers 28 are engaged in the recesses 14 and retracted when it is desired to relocate the plungers 28 in fresh recesses 14. It can be appreciated that this sequence is analogous to that carried out when raising the leg 11.

If it is desired to raise the platform 10 relative to all the legs 11 which may be supported on a ground surface then the plungers 28 of the locking mechanisms 27 associated with all the legs 11 are all engaged in the aligned recesses of the bars 13 of the legs 11 while the plungers 34 are released. All the rams 22 are then extended in unison in a similar manner as described to lower one of the legs 11, but here since the legs 11 are held firmly on a ground surface the cylinders of the rams 22 remain static and the piston rods 25 rise. Since these piston rods 25 are coupled to the support members 15 by the traverses 20 the support members 15 and hence the platform 10 locked thereto with the shoes 18 and the feet 16 will also rise. To lower the platform 10 the rams 22 are all retracted in unison, in similar manner as described to raise one of the legs 11.

When any of the legs 11 or the platform 10 has been moved to a new position as desired the plungers 34 of the locking mechansisms 32 would be engaged in the associated recesses 14 of the bars 13 so that the platform 10 and legs 11 are locked to one another.

The co-operation between the shoes 18 and the feet 16 of the support members 15, allowing angular displacement of the latter, enables the entire device S to move in relation to the platform 10 and more particularly to adjust itself to any deviation of the associated leg 11 from a vertical disposition. Moreover this feature ensures that the forces produced by the rams 22 are directed essentially parallel to the leg 11 and ensures that working loads are distributed uniformly.

We claim:

1. An apparatus comprising a platform, a plurality of legs for supporting the platform, each leg having a series of vertically-spaced reception recesses, a device for each leg for effecting relative movement between the leg and the platform, each device comprising support members generally upstanding relative to the platform, means for selectively locking the support members to the leg, each support member locking means including a carrier and a plunger slidably mounted within the carrier, the plunger being selectively enngageable in the recess of the leg, the support members having bracket guideways for supporting the carrier, the carrier being movable substantially vertically to a limited extent with relation to the bracket guideways, a carriage, means for selectively locking the carriage to the leg, each carriage locking means including a plunger slidably mounted within the carriage, the plunger being selectively engageable in the recesses of the legs, ram means for effecting relative movement between the carriage and the support members in the direction of the longitudinal axes of the latter, and means for connecting the support members to the platform for accommodating limited universal angular movement of the support members and hence of the device as a whole in relation to the platform.

2. Apparatus according to claim 1, further having means for adjusting the position of the carrier along the support member bracket guideways.

3. Apparatus according to claim 2, wherein the carrier position adjustment means includes a threaded spindle attached to the carrier, a threaded bush supportably engaging the spindle, and a motor drivably coupled to the threaded bush to vertically raise and lower the spindle and the attached carrier.

4. Apparatus according to claim 3, wherein a housing is provided for accommodating the spindle and bush, the housing being mounted on the bracket guideways.

5. Apparatus according to claim 2, wherein each bracket guideway of the support members has guide tracks, and the associated carrier has flanges which slidably engage the guide tracks for movement thereon.

6. Apparatus according to claim 1, wherein four support members are provided for each leg, the four support members being arranged in two side-by-side pairs on diametrically opposite sides of the associated leg.

7. Apparatus according to claim 1, wherein the connecting means comprises a foot plate provided at the lower portion of each support member, and a shoe affixed to the platform, the foot plate being engaged within the shoe.

8. Apparatus according to claim 7, wherein the foot plates and shoes have interengaging curved surfaces constituting spherical joints.

9. Apparatus according to claim 8, wherein the centre of curvature of said curved surfaces lies on the longitudinal axis of the associated leg.

10. Apparatus according to claim 6, wherein the legs each have two bars containing the vertically-spaced recesses, the bars being affixed to the diametrically opposite sides of the leg, and the support member selective locking means being located between the support members of each pair of support members.

11. Apparatus according to claim 1, wherein a traverse interconnects the upper ends of the support members and the upper ends of the ram means, the ram means being connected at its lower ends to the carriage.

12. Apparatus of claim 11, wherein the piston rods of the ram means are pivotably connected to the traverse, and the cylinders of the ram means are pivotably connected to the carriage.

13. Apparatus of claim 1, wherein the support member selective locking means includes a ram for driving the plunger into the leg recesses, and an adjustable linkage interconnecting the ram and the plunger.

14. Apparatus of claim 10, wherein the carriage selective locking means is located between the support members of each pair of support members, the carriage locking means being vertically-spaced from the support member locking means.

* * * * *